United States Patent [19]

Trendel

[11] Patent Number: 4,663,913

[45] Date of Patent: May 12, 1987

[54] CLOSURE APPLICATION SYSTEM

[75] Inventor: Alois F. Trendel, Temperance, Mich.

[73] Assignee: Owens-Illinois, Inc., Toledo, Ohio

[21] Appl. No.: 797,319

[22] Filed: Nov. 12, 1985

[51] Int. Cl.[4] ..... B65B 7/28; B67B 3/20

[52] U.S. Cl. ..... 53/314; 53/331.5; 53/367

[58] Field of Search ..... 53/313, 314, 315, 300, 53/331, 331.5, 367, 485, 490

[56] References Cited

U.S. PATENT DOCUMENTS

| | | | |
|---|---|---|---|
| 2,678,763 | 5/1954 | Baer | 53/367 |
| 3,408,788 | 11/1968 | Greck | 53/367 |
| 3,432,989 | 3/1969 | Bouzereau | 53/300 |
| 4,308,707 | 1/1982 | Willingham | 53/314 |

*Primary Examiner*—Robert L. Spruill
*Assistant Examiner*—Donald R. Studebaker
*Attorney, Agent, or Firm*—John R. Nelson

[57] ABSTRACT

A method and apparatus for maintaining critical alignments between the neck of a container and closure application stations. The embodiment disclosed illustrates apparatus for handling containers during the process of filling and applying closures to the filled containers. A star wheel with outwardly opening container body pockets and a container guide rail receives filled containers as they are descending from a filling position, and moves the containers through closure pickup and pre-tightening apparatus to a closure applicating machine. A container neck guide receives and guides the necks of filled containers along a predetermined path through the pickup and pre-tightening stations. The neck guide, pickup and pre-tightening stations are supported on the same structure to insure that the predetermined alignment positions are maintained.

5 Claims, 9 Drawing Figures

CLOSURE APPLICATION SYSTEM

BACKGROUND OF THE INVENTION

1. Field of the Invention

This invention relates generally to the application of closures to containers and, more particularly, to apparatus for obtaining more precision in the initial application of a closure to the finish or neck of a container. It is particularly useful where conventional neck guides cannot be used with threaded closures.

2. Description of the Prior Art

Innovation in the bottling industry is very dependent on the ready availability of machinery for processing new types of containers and closures. For years, the crown was the dominant closure employed. A different type of closure was then developed, which comprised a cap shell of aluminum which was inserted over the threaded neck end of the container and then secured in place by rolling threads in situ into the walls of the cap shell. Such closures are commonly called roll-on caps.

The roll-on cap necessarily required a completely new applicating machine because not only was an axial force necessary to hold the closure in place on the bottle neck and effect a seal between the closure liner and the end of the bottle neck, but concurrently, a rotating movement had to be imparted to the thread forming rollers. There was no practical way that a conventional crown-type applicating machine could be modified to apply the new style roll-on closures and, as a result, the adoption of the closure proceeded very slowly. It did proceed, however, and now machinery for applying roll-on closures is common.

In recent years, there have been significant developments in plastic technology, making the utilization of a threaded plastic closure completely feasible for use in the carbonated beverage field. For example, a threaded closure of the type shown in U.S. Pat. Nos. 3,987,921 and 4,016,996 has been shown to be commercially practicable, and an economically desirable change for the bottler to adopt if applicating machinery was available to assemble the plastic closure to the bottle neck.

Since the plastic closure required a concurrent application of an axial force to the top panel of the closure with a rotation of the closure relative to the bottle neck, it was desirable to utilize existing closure applicating machines for effecting the assembly of aluminum shells to bottle necks to apply the new style plastic closure, and thus minimize the new investment required by the bottler. This was accomplished by a number of modifications of capping heads which may be applied to existing roll-on closure applicating machines.

Some of the roll-on type applicating machines do not incorporate a sufficient rotational movement of the capping head as it approaches its lowermost position relating to the bottle to effect the complete threading of a closure onto the threaded bottle neck. Therefore, pre-tightening mechanisms were developed, which partially apply a threaded closure on the threaded neck of a bottle prior to a closure being engaged by the applicating head.

While the pre-tightening mechanisms have improved the operation of the capping process, the pressure to obtain ever higher line speeds has made the initial cap pick-up by the container finish or neck more critical to avoid operation problems. The neck or finish has previously been guided into cap pick-up position by a neck guide star wheel plate on the in-feed star wheel. This was satisfactory at lower speeds and when aluminum shells were placed on the necks to have threads rolled in place after initial cap application. However, threaded plastic closures can encounter cocking or cross threading problems which pre-tightening mechanisms may not correct at high speeds. Moreover, a neck guide plate may not be used in some bottling lines, e.g. when the cap applicating machine is being fed directly from a filling machine, and the filling bottle pedestal has a feeding machine height at the time of transfer to the in-feed star wheel of the cap applicating machine which will not permit acceptance of the bottle neck by the neck guide plate. Therefore, there is a need for an improved closure application system which includes a better apparatus for and a method of aligning the finish or neck of a bottle with a cap pick-up mechanism and pre-tightening apparatus.

SUMMARY OF THE INVENTION

The invention provides an improved method and apparatus for maintaining critical alignments between the neck of a container and closure application stations. In the embodiment shown herein the apparatus for applying threaded closures to threaded necks of containers includes a closure pickup station for successively placing closures on container necks and a closure pre-tightening station for initiating threading of a closure onto the container neck. A star wheel moves the containers on a path through the pickup and pre-tightening stations. Neck guide means guides the moving containers into closure pickup and pre-tightening alignment at the stations. The neck guide means is associated with the operation stations on an integrated or unitary support means, thereby enabling maintenance of the desired predetermined alignment positions of the container neck with the stations.

The neck guide means includes guide members disposed on each side of the container path at container neck height. Each of the guide members has a container contact surface which preferably conforms to the contour of the container neck, and on outwardly flaring entry surface to direct the container necks toward an alignment position defined by the container contact surfaces.

The novel method for applying closures to containers includes moving a container through a closure application station and guiding the neck of the container along a predetermined path through the application station. This is accomplished by supporting both a neck guide means and the application station from the same support structure to insure that the predetermined path is maintained in the desired alignment with the application station. Disposing guide members on each side of and along the predetermined path mechanically maintains the alignment.

Other objects, advantages and features of this invention will become more apparent during the course of the following description when read in conjunction with the accompanying drawings.

BRIEF DESCRIPTION OF THE DRAWINGS

In the drawings, where like numerals are employed to designate like parts throughout.

DESCRIPTION OF THE PREFERRED EMBODIMENT

Figure 1:
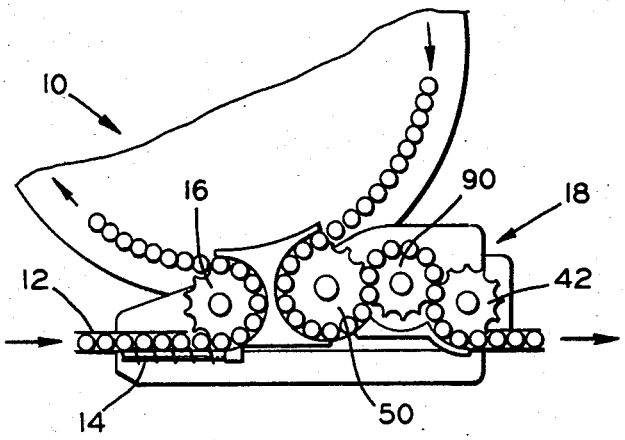
FIG. 1 is a diagramatic layout of a filling machine feeding filled containers to a capping machine.
Figure 2:
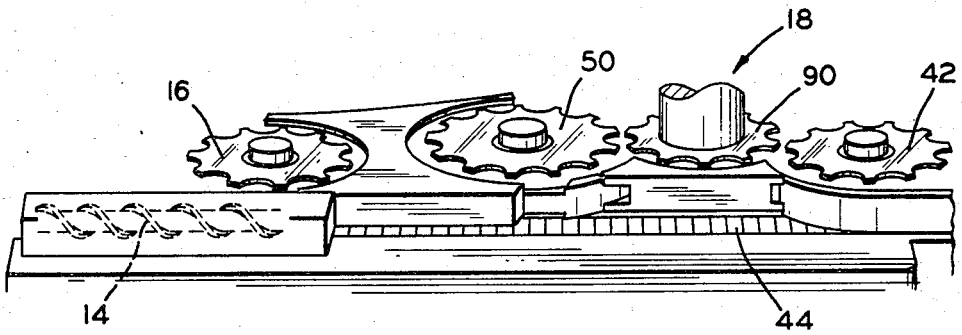
FIG. 2 is a schematic view in perspective of portions of the feeding and bottle control mechanisms of the apparatus in FIG. 1.

Referring now to FIGS. 1 and 2 there is illustrated a combination of filling and capping apparatus which may utilize the teachings of this invention. A machine designated generally at 10 receives empty containers from filling in-feed conveyor 12. The containers are transferred from conveyor 12 to the filling machine 10 by an in-feed worm 14 and a filling machine transfer star wheel 16.

Filling machines 10 are well known in the art and include cam or pneumatically operated bottle lifts or pedestals which raise the containers or bottles from the level of the filler transfer star wheel 16 up to and against filler valves. After filling, the containers are lowered away from filler valves by the bottle lifts or pedestals and are transferred to a cap applicating machine designated generally at 18 by a capper in-feed star wheel 50.

Figure 3:
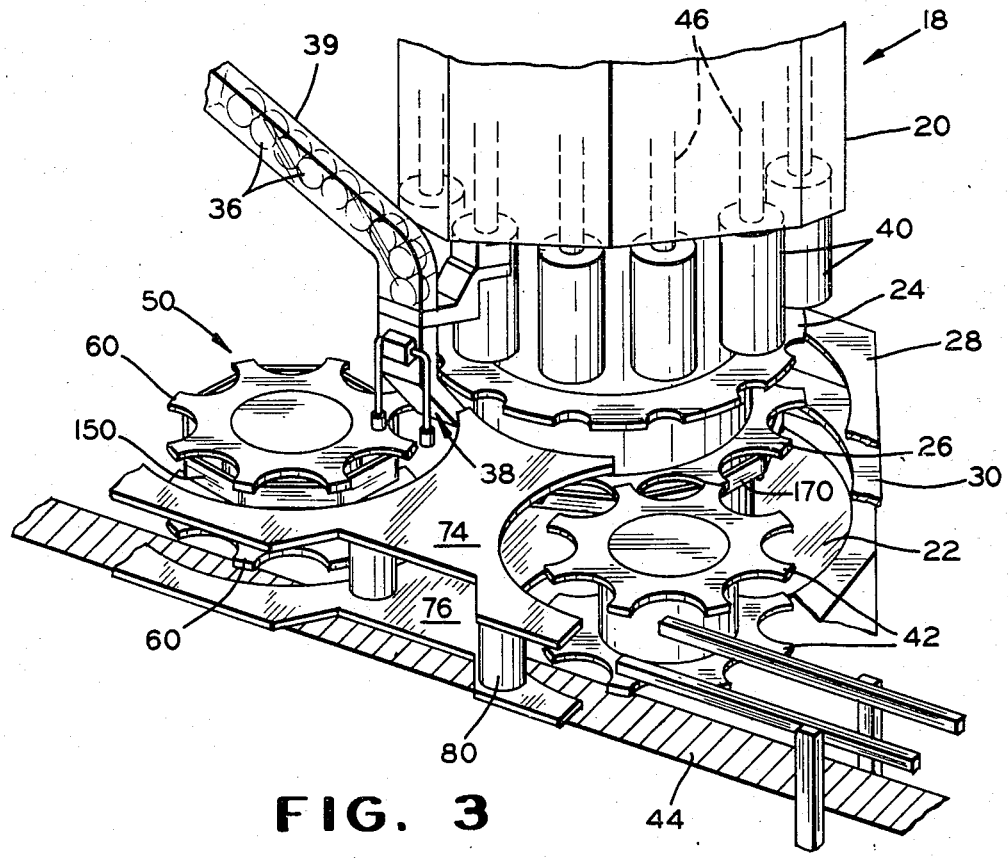
FIG. 3 is a schematic perspective view of a complete cap applicating machine which may utilize the teachings of this invention.

Referring now to FIG. 3 there is illustrated a capping machine 18 of the type manufactured and sold by Aluminum Company of America for the application of roll-on closures to the threaded necks of beverage bottles. This machine and conversion apparatus for providing capping heads to effect the application of an internally screw threaded plastic closure to the threaded neck of a bottle is discussed and disclosed in U.S. Pat. No. 4,295,320 and other U.S. Patents. Therefore, the mechanism of the entire capping machine will not be described in detail.

A rotating turret 20 moves with a rotating capper bottle table 22. Capper star wheels 24 and 26 located above table 22 also rotate with table 22 and provide lateral support to the side wall and neck portions of the bottles as they are moved in a circular path by the rotary bottle table 22. Guide rails 28 and 30 hold the bottles in the outwardly opening capper star wheel pockets.

Bottles, which may be filled with carbonated beverage or any other liquid product, are supplied to the rotary table 22 by an in-feed or transfer star wheel 50. Before entering the rotary table 22, an internally threaded plastic cap 36 is loosely deposited on the neck of each bottle by a cap feeding mechanism 38, which includes cap feeding chute 39. The caps 36 are successively engaged by rotating applicating heads 40 and applied to the threaded neck of the bottles as the bottles are moved around beneath the heads 40 by the rotary table 22. The capped bottles are removed from the rotary bottle table 22 by a conventional out-feed star wheel 42 and deposited on a moving conveyor 44 which conveys them to a case packer (not shown).

The rotating turret 20 of the capping machine provides a mounting for a plurality of vertically disposed hollow shafts 46 on the bottom end of which are the capping heads 40. The shafts 46 are continuously rotated and, as the shafts 46 are moved in their rotary path by the turret 20, they are successively vertically displaced toward the rotary bottle table 22 to bring the capping heads 40 respectively into firm engagement with the top portion or panel of a cap 36 which is respectively positioned on the neck of a bottle beneath each capping head. Capping heads 40 exert a combined axial thrust and rotational force upon each cap 36 to effect the threading of the cap 36 onto the threaded neck of a bottle, following which the capping heads are raised relative to the bottle and the capped bottle is thus freed for discharge into the removal or out-feed star wheel 42.

Figure 4:
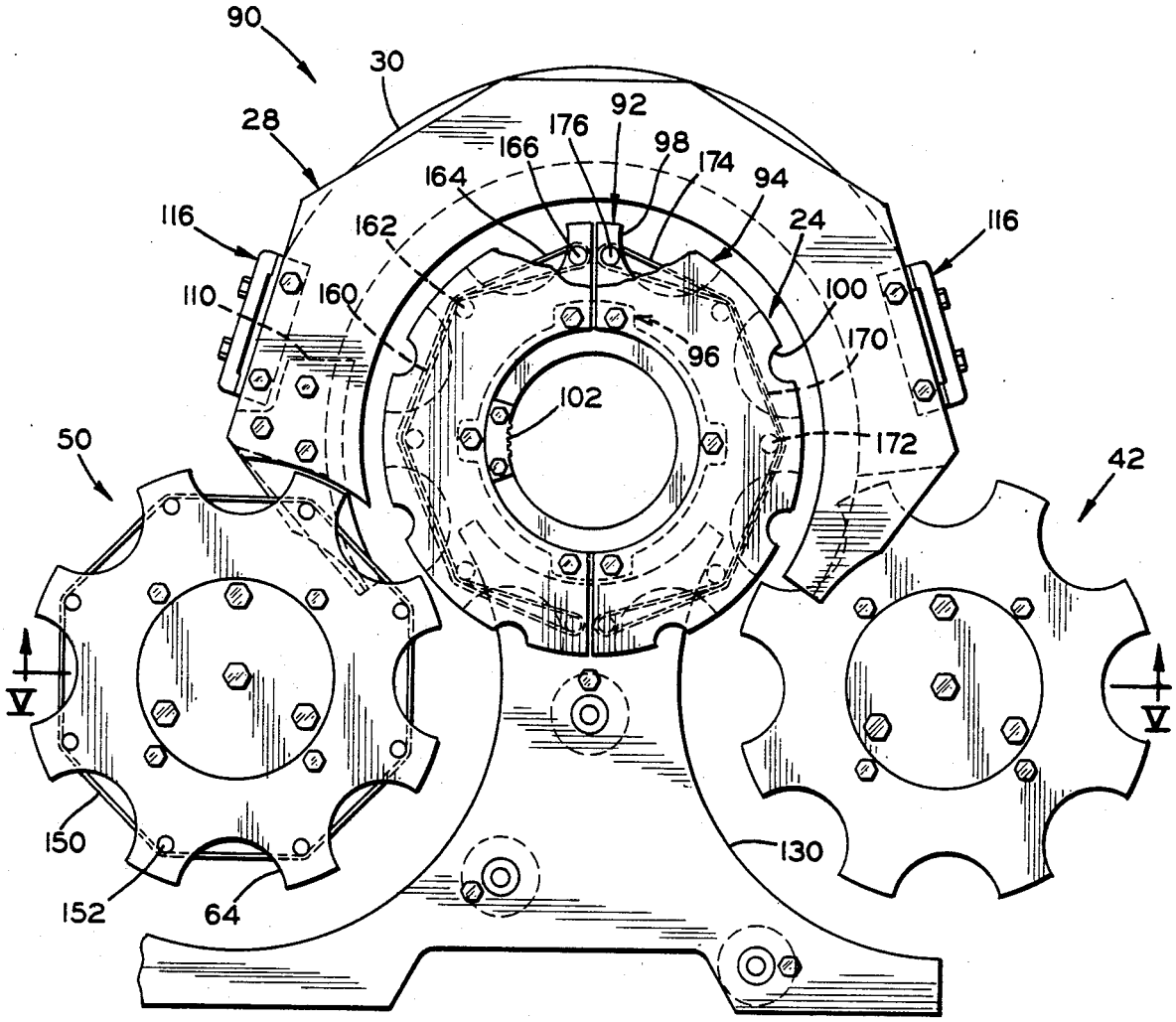
FIG. 4 is a plan view of in-feed, capping and discharge star wheel assemblies that may be used in the machine illustrated in FIG. 3.
Figure 5:
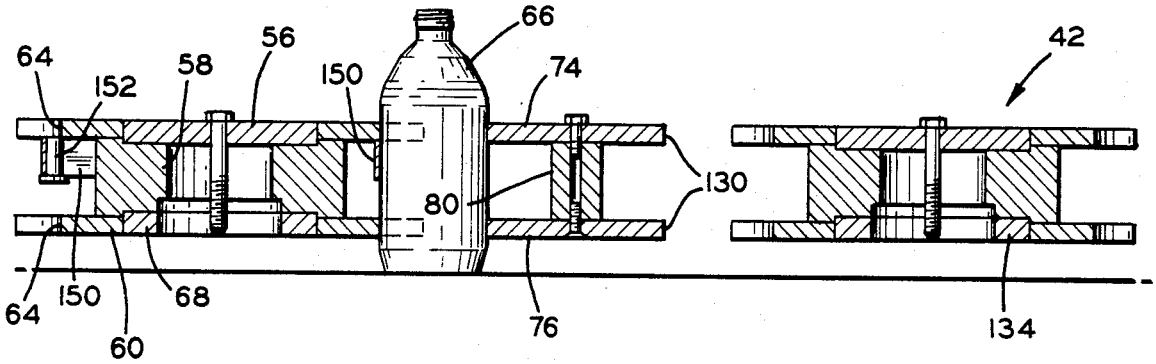
FIG. 5 is a cross-sectional view taken along lines V—V of the apparatus illustrated in FIG. 4.

Referring now to FIGS. 4 and 5 there is illustrated in greater detail in-feed, capper and discharge star wheel assemblies which are useful with the type of capping machine shown and described generally in FIG. 3.

An in-feed star wheel assembly is designated generally at 50. A hub cap is shown at 56, and with full hub 58 supports in-feed star bottle body plates 60 in a desired spaced and aligned position so that body pockets 64 respectively formed in plates 60 may receive bottles 66 as shown in FIG. 5 from the filling machine 10. A timing ring 68 coordinates the movement of in-feed star assembly 50 with the movement of the capper star wheel assembly 90 and the discharge star wheel assembly 42.

In-feed bottle body guides 74 and 76 are held in spaced and aligned positions by spacer support assemblies 80 to guide bottles 66 into pockets 64 and retain the bottles therein.

A capper star wheel assembly is designated generally at 90 and includes a bottom capper split star wheel 92 and a top capper split star wheel 94. A split hub assembly 96 supports the bottom and top split star wheels in spaced and aligned positions so that body pockets 98 and neck pockets 100 receive bottles 66. A timing ring means 102 coordinates the movement of the capper star wheel assembly 90 with the in-feed and discharge star wheel assemblies 50 and 42. The capper star wheel assembly is formed in the split segment arrangement as shown so that it may be attached to and removed from the cap applicating machine without a major disassembly of the entire machine.

Bottom capper in-feed guides 110 and 30 cooperate with top capper in-feed guide 28 to enable transfer of bottles 66 from the in-feed star wheel assembly 50 to the capper star wheel assembly 90. Bracket assemblies 116 support guides 110, 30, and 28 in the desired spaced and aligned relationship.

Upper and lower bottle body discharge guide surfaces 130 transfer the bottles 66 from the capper star wheel assembly 90 to a conventional discharge star wheel assembly 42, which then deposits the bottles 66 on the discharge bottle conveyor 44. A timing ring 134 coordinates the movement of the discharge star wheel assembly 42 with star wheel assemblies 50 and 90.

To prevent container rotation while they are in star wheels 50 and 90, container restraint systems are provided to improve pre-tightening and capping operations. A belt 150 is supported on the in-feed star wheel 50 from a plurality of belt posts 152 depending from the upper bottle body plate 60. Similarly, belt segments 160, 170 are supported by belt posts 162, 172 beneath bottle body star wheel plate 92 of split star wheel assembly 90.

The belt 150 and belt segments 160, 170 are positioned by the belt posts so that the outer surfaces subtend an arc of the bottle body pockets 64 and 98, respectively. When a bottle 66 is received by either star wheel the belt or belt segment is stretched inwardly to wrap around and conform to the contour of the bottle body. The surface friction exerted by the belt is greater than the surface friction of the guide rails, thereby preventing the bottles from rotating in the bottle pockets.

As an aid in the capping process, pre-tightening mechanisms as disclosed and described in U.S. Pat. No. 4,308,707 have been added to the capping machinery. Some roll-on type applicating machines did not incorporate a sufficient rotational movement of the capping head as it approaches its lowermost position relative to the bottle to effect the complete threading of a closure onto the threaded bottle neck.

Such a pre-tightening mechanism will partially apply a threaded closure on the threaded neck of a bottle prior to the closure being engaged by the applicating head. Pre-tightening on the order of one half to a full turn of the closure threads relative to the bottle threads may be required and, during the initial threading action, it is very desirable that a constant downward force be maintained on the panel portion of the closure. At the same time, the panel portion of the closure must be maintained in a horizontal plane. In this manner, cocking or cross threading of the closure on the bottle threads will be avoided.

Figure 6:
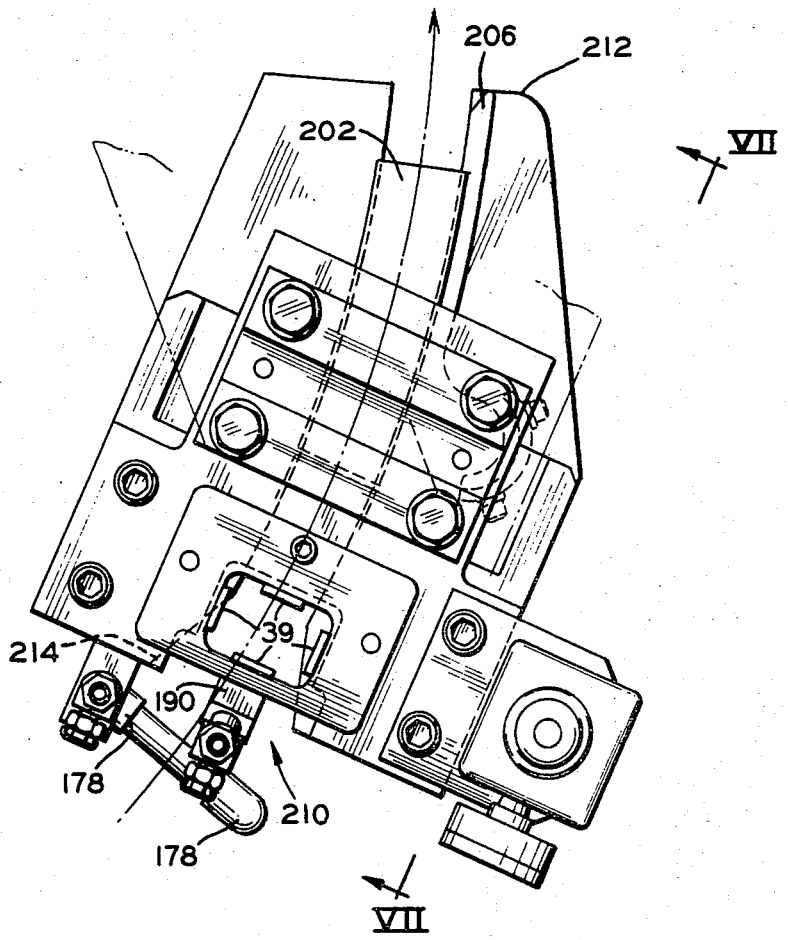
FIG. 6 is a plan view of closure application stations embodying the teachings of this invention.
Figure 7:
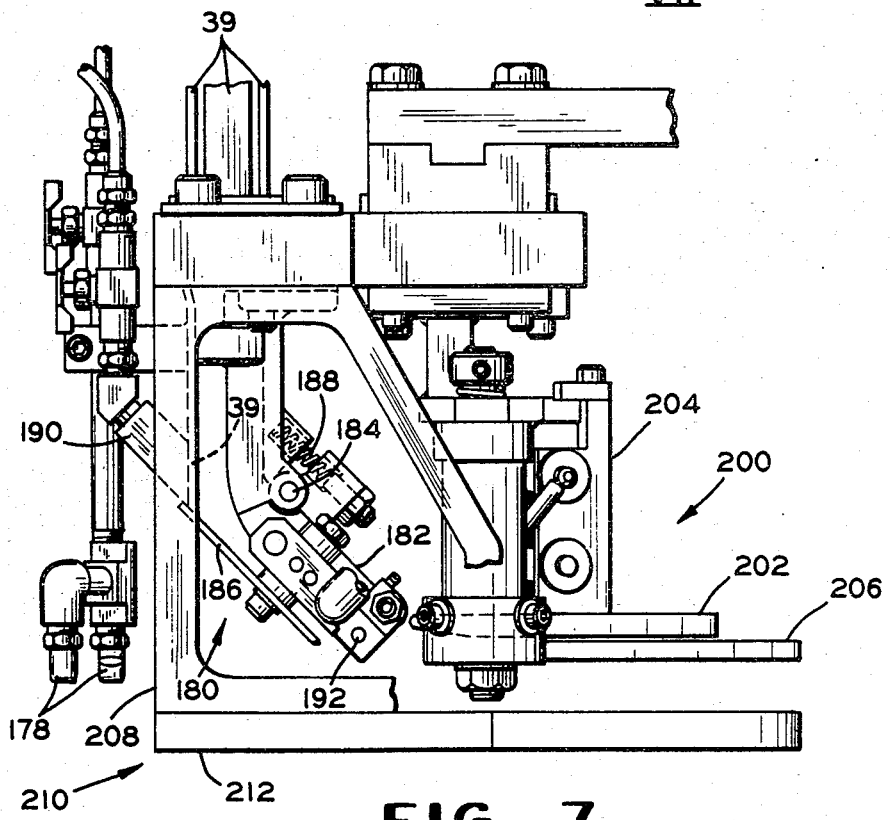
FIG. 7 is a side elevational view of the apparatus illustrated in FIG. 6 taken along sectional lines VII—VII of FIG. 6.
Figure 8:
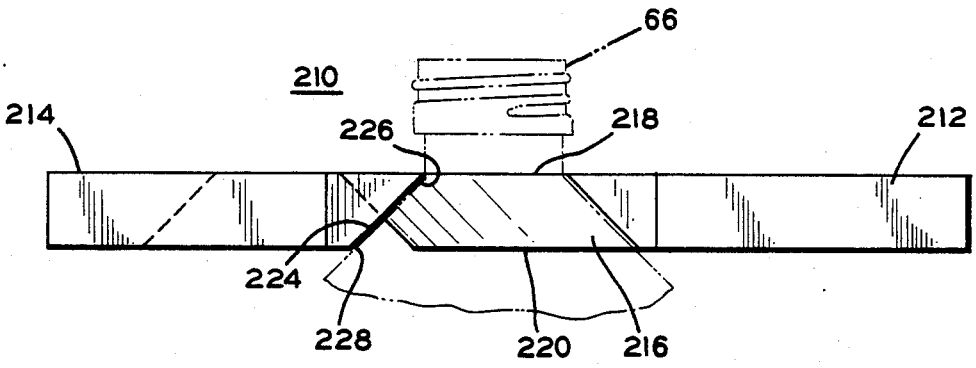
FIG. 8 is a front elevational view of the neck guides utilized in FIGS. 6 and 7.

Referring now to FIGS. 6, 7 and 8 there is illustrated cap feeding, pick-up, pre-tightening and neck guide apparatus which incorporate the teachings of this invention.

Prior to entering the cap pickup station fluid nozzles 178 spray the finish or neck of each container to clean product therefrom before further capping operations. The cap feeding chute rails 39 feed the closures 36 to a cap pickup apparatus designated generally at 180, which includes a cap dispenser housing 182 pivotally supported at 184. A cap dispensing plate 186 is attached to housing 182 and is urged by spring biasing 188 upwardly against the bottom of a chute rail 39. The caps 36 descend through chute 39 and are urged along dispensing plate 186 by an air jet from air nozzle 190 to a cap pickup position defined by opposing ball stops located at 192 inside the housing 182. The ball stops yielding engage the opposite sides of a closure so that the open side of the closure extends down past the end of plate 186. When a bottle is guided by the pickup mechanism, the leading edge of the bottle finish or neck slips into the open side of the closure and pulls the closure loose from the opposing ball stops, allowing the closure to fall onto the neck.

The bottle with the closure loosely sitting on the finish then moves to the pre-tightening apparatus designated generally at 200. A hold-down plate 202 is supported from a linkage mechanism 204 which maintains the bottom surface of the plate 202 horizontal, and thus also the top panel of a closure in contact therewith. The closure is therefore leveled to prevent cocking or cross threading on the bottle neck.

After leveling of the closure, the closure next comes in contact with a serrated, frictional rail 206 which is disposed along the path of movement of a closure loosely positioned on the neck. The rail 206 engages the side wall of the closure and effects a relative turning of the closure with respect to the bottle neck, so as to initiate the threading of the closure onto the threads on the bottle neck. Concurrently, the top panel of the closure is still engaged by the hold-down plate 202 which, through the string biased linkage 204, maintains the top panel in a horizontal plane and provides a constant axially downward force on the closure to assist in initiating threading.

The cap pickup and pre-tightening functions just described are difficult operations which require precise alignment of the various mechanisms. These alignments are troublesome to maintain as line speeds are increased, especially when combined with possible alignment problems resulting from using the normal neck guide procedures. That is, in the past the neck of a bottle has been guided into the cap pickup and pre-tightening areas by a rotating neck guide star wheel plate mounted on the in-feed star wheel, in cooperation with a stationary neck guide rail disposed along and outside of the circumference of the rotating neck guide plate.

In addition, when an existing filling and capping equipment set up is being changed from roll-on closures to threaded plastic closures, substantial modifications are required. For example, in the set up illustrated in FIGS. 1 and 2 the filled bottles coming from the filling machine 10 are still elevated by the bottle lifts or pedestals at the time of transfer to in-feed star wheel 50. Therefore, the addition of a neck guide star wheel plate to in-feed star wheel 50 is not possible without moving the filling and cap application machines further apart and adding additional intermediate transfer mechanisms. Not only is this expensive and time consuming, but space on the plant floor may limit the modifications in machine positions and layouts.

In the present invention neck guide means indicated generally at 210 include an outer neck guide 212 and an inner neck guide 214, both connected to the same support brackets 220 which carry the cap pickup and pre-tightening mechanisms.

Figure 9:
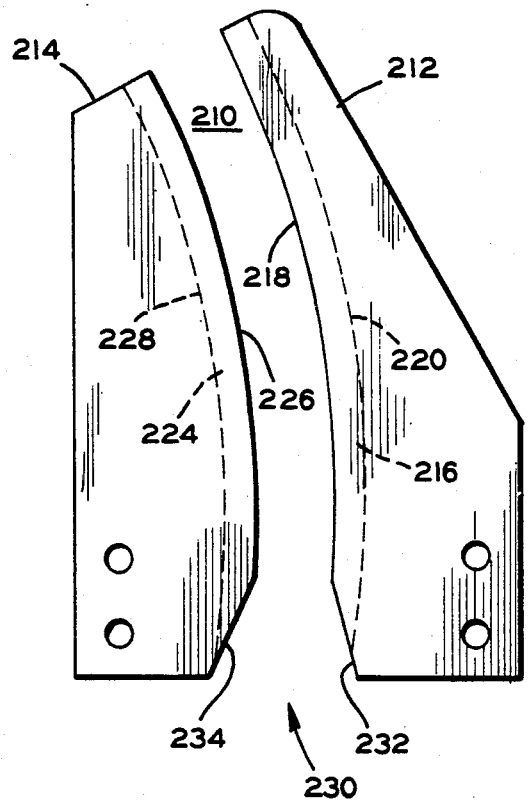
FIG. 9 is a plan view of the neck guides illustrated in FIG. 8.

As best seen in the plan views in FIGS. 6 and 9, the neck guides 212, 214 are disposed along and on each side of the pitch circle or bottle path proscribed by the in-feed star wheel 50. The front view of the guides 212, 214 in FIG. 8, is presented in the same aligned relationship with respect to each other as if they were attached to the bracket support reans 208. Similarly, the plan view of FIG. 9 illustrates the same aligned relationship. The guides 212, 214 are preferably formed from a smooth plastic material, such as nylon, to reduce the rotational friction against a bottle and to avoid abrasion of bottle surfaces.

The outer guide 212 has a container facing surface 216 which is defined by an upper edge 218 and a lower edge 220. The edges 218 and 220 define arcs of circles having their centers at the middle of the in-feed star wheel 50. The diameters of those circles are slightly larger than the diameter of the pitch circle, plus one-half of the diameter of the container at contact points along edges 218, 220. In the embodiment shown, the arc of edge 220 has a larger diameter to accomodate a bottle neck that increases in diameter from the finish to the body of the bottle. Thus, the contact surface 216 slopes away from the vertical from the upper edge 218 to the lower edge 220.

Similarly, inner guide 214 has a container facing surface 224 defined by upper and lower edges 226, 228, which define arcs of circles having their centers at the middle of the in-feed star wheel 50. The diameter of these circles are slightly smaller than the diameter of the pitch circle, minus one-half of the diameter of the container at contact points along edges 226, 228. Again, the contact surface 224 slopes away from the vertical from edge 226 to edge 224 to accomodate a bottle neck that increases in diameter from the finish to the body of the bottle.

At the entrance 230 of the neck guide path formed by guides 212, 214 the guides have entry surfaces 232, 234 that flare outwardly from upper edges 218, 226 to steer necks that are not centered on the pitch circle back into alignment with the guide path defined by guide surfaces 216, 224 and thus also into precise alignment for the cap pickup and cap pre-tightening operations.

Since the neck guide means 210 is secured to the same bracket supporting both the cap pickup and cap pre-tightening mechanisms, alignment of the finishes or necks of containers with respect to both such mechanisms can be insured in the initial assembly of the neck guide means to the bracket support means. Adjustments if needed, can be made with shims at the various connection points of the mechanisms to the main support brackets.

The method and apparatus of this invention thus provide substantial improvement in alignment of container finishes with cap pickup and pre-tightening mechanisms, enabling operation at high line speeds. In addition, the neck guide plate on the in-feed star wheel and the accompanying peripheral guide can be eliminated for equipment cost savings. Further equipment, set-up time, and plant floor space savings can be obtained when applying the invention to existing filling-capper installations.

It is to be understood that the form of the invention herewith shown and described is to be taken as an illustrative embodiment only, and that various changes in the shape, size and arrangement of the parts or in the steps of the method may be made without departing from the spirit and scope of the invention.

I claim:

1. Apparatus for applying threaded closures to threaded necks of containers, comprising:

(a) a closure pickup station for successively placing closures on container necks, (b) a closure pre-tightening station for initiating threading of a closure onto a container neck, (c) means for moving containers on a path through said pickup and pre-tightening stations, and, (d) means beginning before and terminating after said stations for guiding necks of said moving containers into closure pickup and pre-tightening-tightening alignment at said stations including stationary guide members disposed on each side of said container path at neck height, said neck guide means being associated with said stations on an integrated support means separate from said container moving means thereby enabling maintenance of predetermined alignment positions of said container neck with said stations.

2. Apparatus as defined in claim 1 in which each of said guide members has a container contact surface which conforms to the non-vertical contour of the container neck.

3. Apparatus as defined in claim 1 in which each of said guide members has container contact surfaces which are formed from a smooth plastic to reduce frictional rotation forces on said container and to prevent abrasion of said container necks.

4. Apparatus for handling containers during the process of filling and applying closures to the filled containers, comprising:

(a) transfer means including star wheel means having outwardly opening container body pockets and container body guide rail means for receiving filled containers from a filling machine as they are descending from a filling position and for moving the filled containers through closure pickup and pre-tightening apparatus to a closure applicating machine, (b) container neck guide means beginning before and terminating after the pickup and pre-tightening apparatus for receiving and guiding the necks of filled containers along a predetermined alignment path through the closure pickup and pre-tightening apparatus including spaced members having arcuate container neck contact surfaces disposed on each side of and along the alignment path above the periphery of said star wheel, and (c) means for supporting said neck guide means and the closure pickup apparatus and pre-tightening apparatus from a unitary structure to maintain predetermined alignment positions therebetween.

5. Apparatus as defined in claim 4 in which said neck contact surfaces are formed from a smooth plastic to prevent container abrasion and reduce friction.

* * * * *